US007040497B2

(12) United States Patent
Weiler et al.

(10) Patent No.: US 7,040,497 B2
(45) Date of Patent: May 9, 2006

(54) HERMETICALLY SEALED CONTAINER WITH CHILD SAFETY OVERCAP

(75) Inventors: Gerhard H. Weiler, Woodstock, IL (US); Kathleen E. Kurek, Des Plaines, IL (US)

(73) Assignee: Weiler Engineering, Inc., Elgin, IL (US)

( * ) Notice: Subject to any disclaimer, the term of this patent is extended or adjusted under 35 U.S.C. 154(b) by 0 days.

(21) Appl. No.: 10/647,961

(22) Filed: Aug. 26, 2003

(65) Prior Publication Data

US 2005/0045579 A1 Mar. 3, 2005

(51) Int. Cl.
*B65D 41/62* (2006.01)

(52) U.S. Cl. ..... 215/277; 215/46; 215/48; 215/204; 215/206; 215/230; 215/217

(58) Field of Classification Search ..... 215/48, 215/46, 206, 204, 295, 901, 330, 339, 316–318, 215/217, 230, 303, 277, 40, 43, 256, 253, 215/209, 224; 220/281, 780, 784, 256.1, 220/258.1–258.3

See application file for complete search history.

(56) References Cited

U.S. PATENT DOCUMENTS

| | | | | |
|---|---|---|---|---|
| 4,620,638 | A * | 11/1986 | Schmidt | 215/11.1 |
| 5,085,332 | A * | 2/1992 | Gettig et al. | 215/249 |
| 5,228,593 | A * | 7/1993 | O'Meara | 222/41 |
| 5,303,835 | A * | 4/1994 | Haber et al. | 215/247 |
| 6,068,148 | A * | 5/2000 | Weiler | 215/48 |
| 6,168,413 | B1 * | 1/2001 | Weiler et al. | 425/524 |
| 6,758,358 | B1 * | 7/2004 | Bloom | 215/206 |

* cited by examiner

*Primary Examiner*—Robin A. Hylton
(74) *Attorney, Agent, or Firm*—Olson & Hierl, Ltd.

(57) ABSTRACT

A child safety overcap is provided for a hermetically sealed container with a twist-off access closure having a unitary grip tab. The overcap has a top portion defining at least one slot adapted to engage the tab on the access closure when the overcap is pushed toward the container and a skirt portion that terminates in an expandable rim, e.g., provided with dentils adapted to flex away from the container when the overcap is pushed toward the container. Beads extending inwardly from a distal end of each of the dentils are adapted to snap into a circumferentially groove formed in a neck portion of the container for removably securing the overcap to the container.

8 Claims, 2 Drawing Sheets

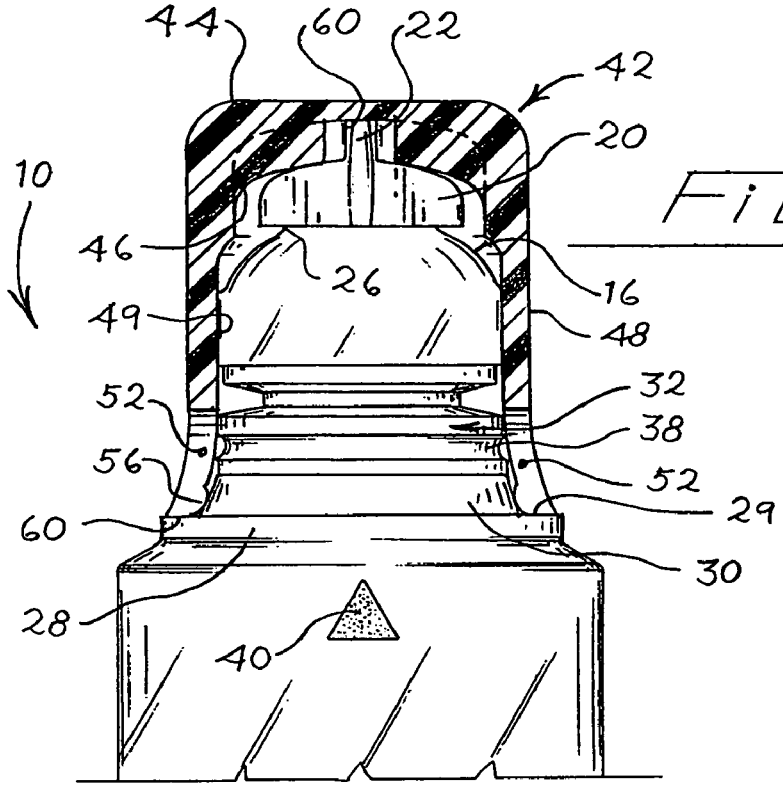
Fig. 4
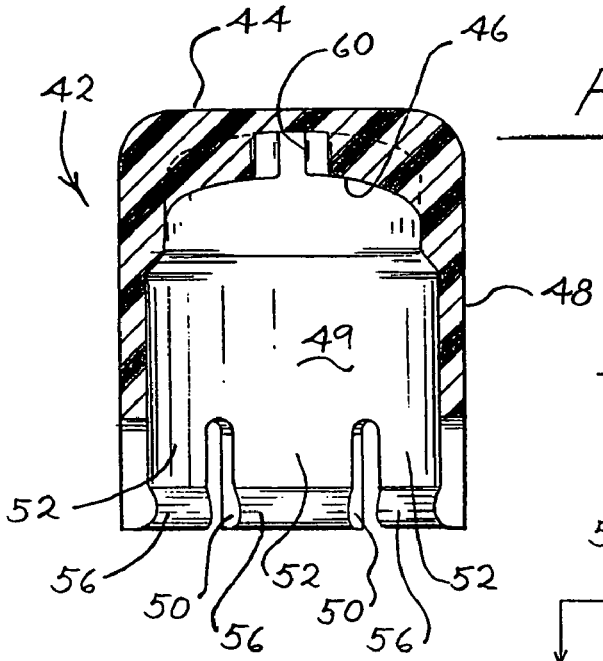
Fig. 6
Fig. 5
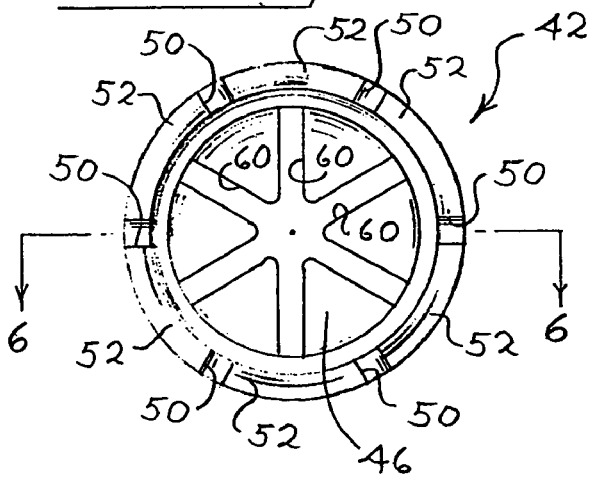

HERMETICALLY SEALED CONTAINER WITH CHILD SAFETY OVERCAP

TECHNICAL FIELD OF THE INVENTION

This invention relates to a hermetically sealed container and, more particularly, to a child safety overcap for a hermetically sealed container.

BACKGROUND OF THE INVENTION

Hermetically sealed containers incorporating twist-off access closures or caps with unitary grip tabs are known in the art. See, for example, the containers disclosed in U.S. Pat. No. 6,068,148 to Weiler and U.S. Pat. No. 6,168,413 to Weiler et al.

A particular advantage associated with these types of containers is that the access closure can easily be removed from the top of the container simply by grasping the tab of the closure and then twisting and snapping the closure from the container. This invention is directed to making the access closure for these containers substantially childproof.

SUMMARY OF THE INVENTION

This invention relates to a child safety overcap for a hermetically sealed container having a twist-off access closure with a unitary grip tab. The overcap is rotatably mounted to the container and comprises a top portion as well as a cylindrical skirt portion unitary with the top portion. The top portion defines at least one internal slot for engaging the grip tab when the overcap is pushed toward the hermetically sealed container. The cylindrical skirt portion terminates in an expandable rim provided with plural dentils or fingers around the periphery thereof which are adapted to flex outwardly when the overcap is pushed toward the container. The twist-off access closure is removed by rotating the overcap while the grip tab is engaged by the overcap.

Each of the dentils has an inwardly extending bead adapted for engagement with a circumferential groove on the hermetically sealed container. In one embodiment, the dentils may be quadrate and in another they may be dactylose.

The skirt portion of the overcap may also bear a rotary position indicator adapted for alignment with a rotary position indicator on the container which in turn aligns the slot in the overcap with the tab on the access closure prior to the overcap being pushed toward the container so as to engage the grip tab.

Other advantages and features of the present invention will be more readily apparent from the following detailed description of the preferred embodiment of the invention, the accompanying drawings, and the appended claims.

BRIEF DESCRIPTION OF THE DRAWINGS

In the accompanying drawings forming part of the specification in which like numerals are employed to designate like parts throughout the same.

FIG. 4 is an enlarged, fragmentary view of the hermetically sealed container of FIG. 2 with the child safety overcap in a position engaging the grip tab of the access closure and shown in vertical cross-section;

FIG. 5 is an enlarged, plan view of the interior of the child safety overcap; and FIG. 6 is an enlarged, vertical cross-sectional view of the child safety overcap taken along the plane 6—6 in FIG. 5.

DETAILED DESCRIPTION OF PREFERRED EMBODIMENT

Figure 1:
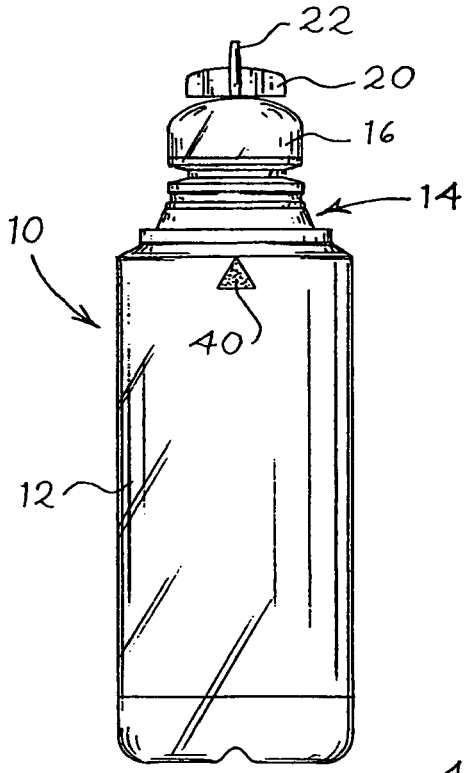
FIG. 1 is a front elevational view of a hermetically sealed container having a closure with a unitary grip tab but having a child safety overcap of the present invention removed therefrom.

The invention disclosed herein is, of course, susceptible of embodiment in many different forms. Shown in the drawings and described below in detail is a preferred embodiment of the container of the present invention. It is to be understood, however, that the present disclosure is an exemplification of the principles of the invention and does not limit the invention to the illustrated embodiment.

For ease of description, the container of the present invention will be described in a normal (upright) operating position and terms such as upper, lower, horizontal, etc., will be used with reference to this position. It will be understood, however, that the container and child safety overcap of the present invention may be manufactured, stored, transported, used, and sold in an orientation other than the position described.

A formed, filled, and hermetically sealed thermoplastic container 10 is illustrated in FIG. 1. Container 10 is preferably fabricated, using a method similar to the method disclosed in U.S. Pat. No. 4,596,110 to Weiler, from conventional molding materials such as polyethylene, polypropylene, and the like, compatible with the contemplated container contents. Container 10 is but one example of such a container, inasmuch as a wide variety of container shapes and sizes can be fabricated.

Figure 2:
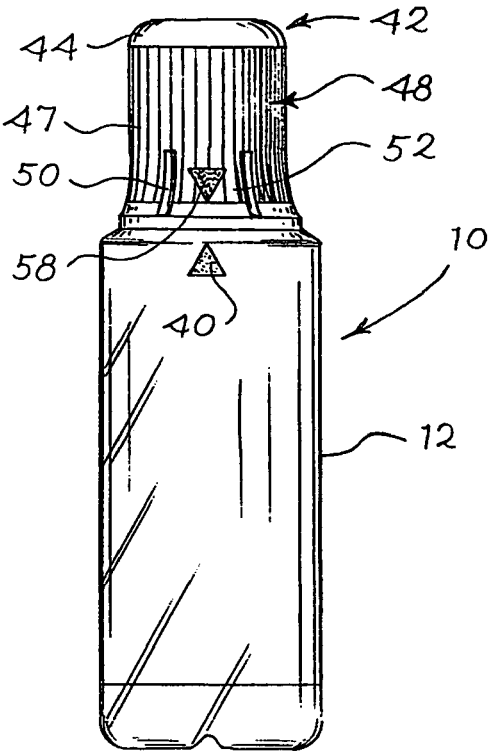
FIG. 2 is a front elevational view of the hermetically sealed container of FIG. 1 with the child safety overcap secured thereto.
Figure 3:
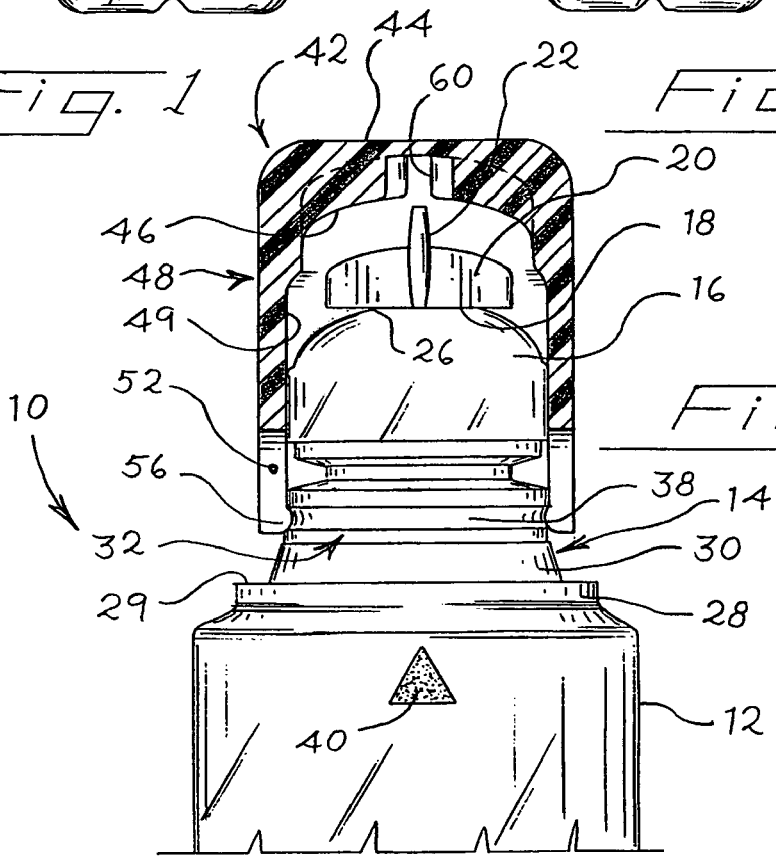
FIG. 3 is an enlarged, fragmentary view of the hermetically sealed container of FIG. 2 with the child safety overcap disengaged from the access closure and shown in vertical cross-section.

Referring to FIGS. 1, 2, and 3, container 10 includes a body portion 12 adapted to be filled with a suitable liquid contents or solution, a neck portion 14 unitary with and in fluid flow communication with the upper end of the body portion 12, a unitary generally dome shaped nozzle 16 extending in a direction away from the neck portion 14 and defining at an upper end thereof dispensing or draining aperture 18. A removable, generally dome shaped twist-off access cap or closure 20 occludes the aperture 18 and is unitary with the nozzle 16. The closure 20, which includes a unitary grasping wing or tab 22, is delineated from the nozzle 16 by a frangible web 26. As can be seen in FIG. 2, a safety overcap 42 is situated over closure 20. Overcap 42 can be injection molded from high density polyethylene, polypropylene, acrylonitrile-butadiene-styrene copolymers, and the like materials.

Referring to FIG. 3, neck portion 14 defines a radial, circumferentially extending shoulder 28 in the region generally adjacent the upper end of the container body portion 12. Neck portion 14 additionally defines a circumferential collar or ramp 30 extending unitarily upwardly and inwardly from the top flat horizontal surface 29 of the shoulder 28, preferably at an angle of about 100 to 105 degrees relative to the surface 29. Ramp 30 terminates in a collar 32. A circumferential groove 38 is defined in collar 32 above ramp 30.

Body portion 12 of container 10 is further characterized in that it incorporates a visual or tactile rotary position indicator 40 located and molded into the outer surface thereof adjacent the neck portion 14.

Referring in particular to FIGS. 2–6, a child safety overcap 42 fitted over the access closure 20 surrounds nozzle 16 as well as neck portion 14 of the container 10.

Overcap 42 is defined by a generally dome-shaped top portion 44 including an interior dome surface 46 (FIG. 3) and a circumferential skirt portion 48 extending downwardly from the outer peripheral circumferential edge of the dome portion 44. Skirt portion 48 includes a serrated outer surface 47, an inner surface 49 (FIG. 3), and a distal peripheral portion or rim that is flexible. Preferably, the rim defines a plurality of elongate generally vertically oriented slits 50 extending around the circumference of the skirt portion 48 in spaced-apart and parallel relationship to one another. The slits 50 separate a plurality of fingers or dentils 52 therebetween which extend around the circumference of the skirt portion 48. Each of the dentils 52 terminates in a distal tip having a head or bead 56 that extends generally radially outwardly from the inner surface 49 of the skirt portion 48.

In the embodiment shown, slits 50 separate generally quadrate or square-shaped flexible dentils 52. It is understood, however, that the dentils 52 can be of various shapes and configurations including, but not limited to, dactylose (i.e., finger-shaped) or orenate (i.e, scallop-shaped). Additionally, and as shown in FIG. 2, one of the dentils 52 bears a rotary position indicator 58 on the outer surface thereof similar to the rotary indicator 40. Indicator 58 is adapted to be aligned with the indicator 40 for the purposes described in more detail below.

As shown particularly in FIG. 5, the inner surface 46 of the dome portion 44 of overcap 42 defines three peripherally spaced, intersecting elongate slots 60 which separate or cut the dome inner surface 46 into a plurality of generally pie-shaped segments. Each of the slots 60 extends substantially the entire inside diameter of the dome portion 44.

In accordance with the present invention, the overcap 42 is secured over the container 10 and, more particularly, over the access closure 20 in the normal course of the manufacturing process after the container has been formed, filled, and sealed. Specifically, overcap 42 is positioned onto the nozzle 16 as shown in FIG. 3 so that the beads 56 of the respective dentils 52 are located and snapped into the groove 38 in neck portion 14. The overcap 42 can rotate freely about the neck portion 14. The resiliency or flexibility of each of the dentils 52 allows the same to flex radially outwardly away from the neck portion 14 as the overcap 42 is pushed toward the container and over the nozzle 16, and then to flex back radially inwardly into the neck portion 14 to allow the beads 56 to be snapped back into the groove 38.

The use and operation of the container 10 and the child safety overcap 42 will now be described with reference to FIGS. 2–4. Initially, and consistent with one of the child safety features of the present invention, the overcap 42 rotates freely about the neck portion 14. To gain access to container contents, overcap 42 is turned to a position where the rotary position indicator 58 on the outer surface of the overcap 42 is aligned with the rotary position indicator 40 on the outer surface of the body portion 12 of container 10. At the same time, by virtue of the relationship between the rotary position indicators, one of the slots 60 in the overcap 42 and the grip tab 22 on the access closure 20, is aligned into a generally co-planar relationship with the tab grip 22. Thereafter, when downward pressure is applied either to the dome portion 44 or skirt portion 48 of the overcap 42, the beads 56 of the respective dentils 52 are urged radially outwardly out of the groove 38. The beads 56 ride downwardly along the outer surface of ramp 30 into the position of FIG. 4, the dentils 52 are flexed outwardly by the interaction of beads 56 with ramp 30 and the peripheral radial end face 62 of the skirt portion 48 is abutted against the top face 29 of the shoulder 28.

When overcap 42 is in the position shown in FIG. 4, the grip tab 22 is received inside the space defined by one of the slots 60 in the dome 44 of overcap 42 so that, upon rotation of the overcap 42 relative to the neck portion 14, the grip tab 22 engages with the surface defining the slot 60 in the dome 44 and causes separation of the access closure 20 by severing the frangible web 26 that secures the access closure 20 to the nozzle 16.

The overcap 42 is preferably rotated a full 360 degrees to assure the complete severance of the frangible web 26. Thereafter, overcap 42 is grasped about the skirt portion 48 thereof and is completely removed from the neck portion 14 to allow the contents of the container 10 to be dispensed through the open nozzle 16. The resiliency of the dentils 52, of course, allows the same to flex away from the neck portion 16 as the overcap 42 is lifted up and away from the container 10.

The foregoing specification and the drawings are to be taken as illustrative but not limiting of the present invention. Still other container and overcap configurations utilizing the spirit and scope of the present invention are possible and will readily present themselves to those skilled in the art.

We claim:

1. A hermetically sealed container comprising:

a hollow body terminating in a neck portion defining an opening and including a downwardly and outwardly extending circumferential ramp and a circumferential groove between the ramp and the opening;

a frangilbe, twist-off access closure including a unitary grip tab and occluding the opening;

an axially moveable overcap rotatably mounted to the container surrounding the access closure and neck portion, the overcap including a top portion and a unitary skirt portion terminating in an expandable rim having plural flexible dentils with inwardly extending distal beads, around the periphery thereof, the circumferential groove adapted for engagement with the inwardly extending distal beads of the dentils;

the top portion defining at least one elongate slot adapted to engage the grip tab, and the ramp adapted for engagement with the inwardly extending distal beads of the dentils so as to increasingly deflect the dentils in an outward direction storing a bias force in the dentils which increases with increasing deflection of the dentils when the overcap is pushed toward the access closure and then rotated about the neck portion to twist-off the access closure.

2. The hermetically sealed container in accordance with claim 1 further including a rotary position indicator on the body thereof adapted for alignment with an indicator for a slot position on the skirt portion of the overcap.

3. The hermetically sealed container in accordance with claim 1 wherein the overcap defines three peripherally spaced, intersecting slots.

4. The hermetically sealed container in accordance with claim 1 wherein the dentils are quadrate.

5. The hermetically sealed container in accordance with claim 1 wherein the dentils are dactylose.

6. The hermetically sealed container in accordance with claim 1 wherein the skirt portion has a serrated outer surface.

7. The hermetically sealed container in accordance with claim 1 wherein the ramp has a generally frustoconical shape.

8. The hermetically sealed container in accordance with claim 1 wherein the ramp is immediately adjacent the circumferential groove.

* * * * *